US009921603B2

(12) United States Patent
Ono et al.

(10) Patent No.: US 9,921,603 B2
(45) Date of Patent: Mar. 20, 2018

(54) STAGING OPERATION UNIT

(71) Applicant: OMRON Corporation, Kyoto-shi, Kyoto (JP)

(72) Inventors: Takahiro Ono, Aichi (JP); Takehiko Furuta, Gifu (JP)

(73) Assignee: OMRON Corporation, Kyoto (JP)

( * ) Notice: Subject to any disclaimer, the term of this patent is extended or adjusted under 35 U.S.C. 154(b) by 554 days.

(21) Appl. No.: 14/191,796

(22) Filed: Feb. 27, 2014

(65) Prior Publication Data

US 2014/0290428 A1 Oct. 2, 2014

(30) Foreign Application Priority Data

Mar. 27, 2013 (JP) ..... 2013-067573

(51) Int. Cl.
*G05G 1/10* (2006.01)
*G05G 1/02* (2006.01)

(52) U.S. Cl.
CPC ..... *G05G 1/105* (2013.01); *G05G 1/02* (2013.01); *G05G 1/10* (2013.01); *Y10T 74/2084* (2015.01)

(58) Field of Classification Search
CPC ..... H01H 3/08; H01H 3/12; H01H 19/003; H01H 2025/0004; G05G 1/02; G05G 1/025; G05G 1/08; G05G 1/10
See application file for complete search history.

(56) References Cited

U.S. PATENT DOCUMENTS

2004/0154910 A1* 8/2004 Hayashi ..... G05G 1/08 200/412
2013/0306447 A1* 11/2013 Polak ..... H01H 25/06 200/4

FOREIGN PATENT DOCUMENTS

JP 2012-066115 A 4/2012
JP 2012-110372 A 6/2012
WO WO 2012110297 A1 * 8/2012 ..... H01H 25/06

OTHER PUBLICATIONS

Machine Translation of JP 2012-110372, obtained Jul. 6, 2016.*

* cited by examiner

*Primary Examiner* — Richard W Ridley
*Assistant Examiner* — Brian J McGovern
(74) *Attorney, Agent, or Firm* — Osha Liang LLP

(57) ABSTRACT

A staging operation unit has a base member having a convex portion, a rotary member, a bearing member fixed on the convex portion that rotatably mounts the rotary member thereon with respect to the base member, and an accessory. The rotary member has a pushed-in movable member that accepts a push-in operation in a direction along a rotation axis of the bearing member, a rotary operation detection unit that detects rotation of the rotary member and outputs a signal corresponding to a result of the detection of the rotation to outside, and a push-in operation detection unit that detects the push-in operation of the pushed-in movable member and outputs a signal corresponding to a result of the detection of the push-in operation to outside. At least a part of the accessory is housed inside the convex portion.

5 Claims, 11 Drawing Sheets

B-B CROSS SECTIONAL VIEW

BEFORE PUSH-IN OPERATION

AFTER PUSH-IN OPERATION

DETAILED VIEW OF E PART

COMPARATIVE EXAMPLE

STAGING OPERATION UNIT

BACKGROUND

1. Field

The present invention relates to a staging operation unit which is equipped in various types of devices and is used for a user to perform an operation input.

2. Related Art

Conventionally, there are known amusement machines such as pachinko machines, slot machines, and game machines which are equipped with a staging operation unit for a user to perform selection of staging modes and display images and perform other functions.

For example, Japanese Unexamined Patent Publication No. 2012-066115 (published on Apr. 5, 2012) discloses an amusement machine having an operation button equipped with a revolving light therein.

In addition, Japanese Unexamined Patent Publication No. 2012-110372 (published on Jun. 14, 2012) discloses an amusement machine which is equipped with a circular ring-shaped dial operation unit and a cylinder shaped press operation unit housed inside the circular ring of the circular ring-shaped dial operation unit.

SUMMARY

However, the technology of Japanese Unexamined Patent Publication No. 2012-066115 may be inconvenient because a method of an operation input from a user is limited to button operation.

In addition, in the technology of Japanese Unexamined Patent Publication No. 2012-110372, since the circular ring-shaped dial operation unit and the press operation unit are equipped as different members, a player may be required to perform a desired operation after confirming the dial operation method and the press operation method every time the player performs an operation; thus, the operation method may be cumbersome. Further, the technology of Japanese Unexamined Patent Publication No. 2012-110372 realizes a dial operation function and a press operation function, but a staging function of the operation unit itself is not considered, and staging capability of the operation unit is low.

One or more embodiments of the present invention provides an operation unit having high operability and high staging capability.

A staging operation unit according to one or more embodiments of the present invention is equipped with: a base member having a convex portion; a rotary member; a bearing member fixed on the convex portion and configured to mount thereon the rotary member rotatably with respect to the base member; an accessory, the rotary member having a pushed-in movable member provided to accept a push-in operation in a direction along a rotation axis of the bearing member; a rotary operation detection unit configured to detect rotation of the rotary member and output a signal corresponding to a result of the detection of the rotation to outside; and a push-in operation detection unit configured to detect a push-in operation of the pushed-in movable member and output a signal corresponding to a result of the detection of the push-in operation to outside, at least a part of the accessory being housed inside the convex portion.

According to the above configuration, a staging operation unit having high operability and high staging capability can be realized in which the same rotary member has a rotary operation function and a push-in operation function, and further has an accessory function. In addition, since at least a part of the accessory is disposed in the convex portion on which the bearing member is assembled, effective staging can be provided at the center of the staging operation unit.

For example, the accessory may be configured to have a drive unit having a motor and a gear and a movable member configured to be rotated, moved, or deformed by a driving force transmitted from the drive unit. In addition, the accessory may be configured to have a light source unit and a light diffusion member configured to diffuse and stage light emitted from the light source unit.

According to the above configurations, a staging operation unit having high operability and high staging capability can be realized.

In addition, a configuration may be made such that a weight member is mounted at a position, which is in the radial direction of the bearing member and on the outer side than the bearing member, in order to increase a moment of inertia which acts on the rotary member when a rotary operation of the rotary member is performed.

With the above configuration, by providing to the rotary member a mechanism for realizing the rotary operation function and the push-in operation function, and by disposing at least a part of the accessory in the convex portion, it is possible, even if the outer diameters of the convex portion and the rotary member are made large, to allow the rotary operation of the rotary member to be performed easily and smoothly since the weight member increases the moment of inertia which acts on the rotary member when the rotary operation of the rotary member is performed.

The weight member may be configured to have a ring shape whose inner diameter is larger than an outer diameter of the bearing member.

With the above configuration, the weight member can increase the moment of inertia which acts on the rotary member when the rotary operation of the rotary member is performed, whereby it is possible to allow the rotary operation of the rotary member to be performed easily and smoothly.

As described above, according to the staging operation unit according to one or more embodiments of the present invention, a staging operation unit having high operability and high staging capability can be realized in which the same rotary member has the rotary operation function and the push-in operation function and further has the accessory function. In addition, since at least a part of the accessory is disposed in the convex portion on which the bearing member is assembled, effective staging can be provided at the center of the staging operation unit.

DETAILED DESCRIPTION

Embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

(1-1. General Structure of Pachinko Machine 1)

Figure 1:
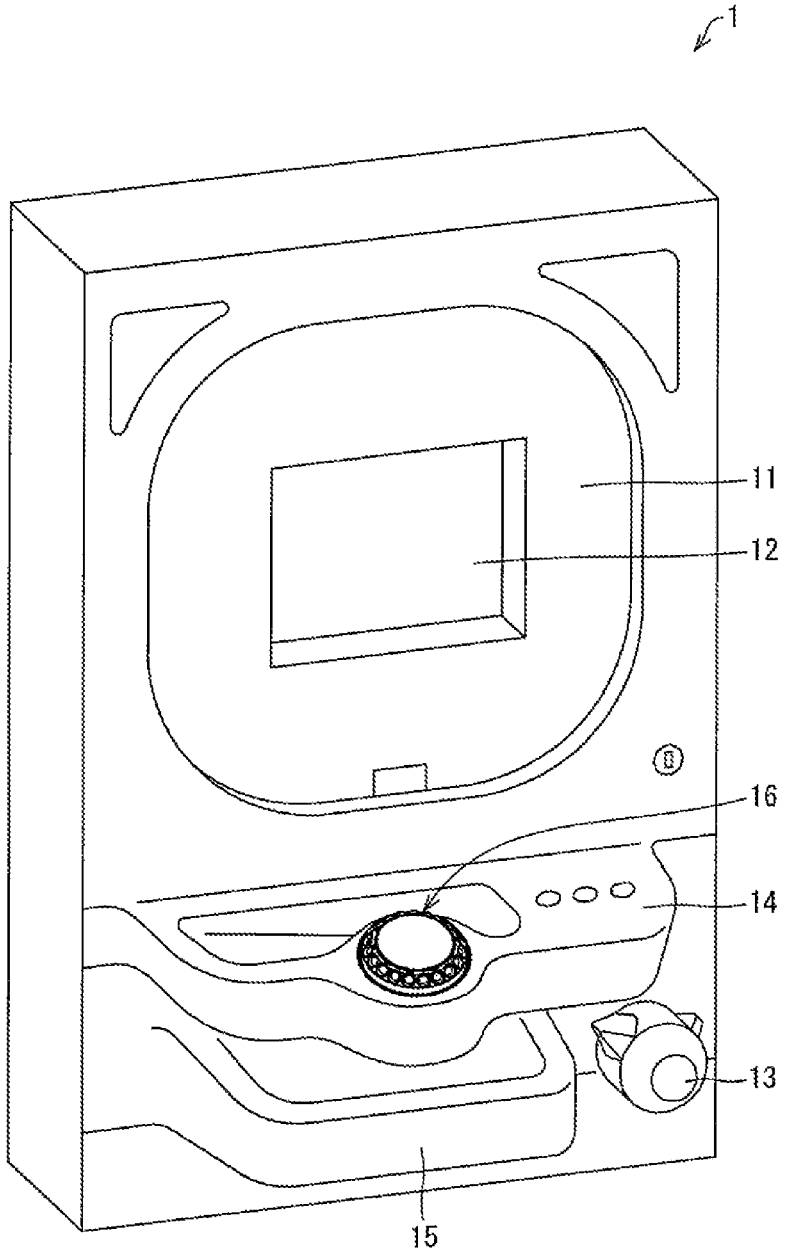
FIG. 1 is a perspective view of an amusement machine according to one or more embodiments of the present invention.

FIG. 1 is an explanatory diagram illustrating a configuration of a pachinko machine 1 as an amusement machine according to one or more embodiments of the present invention. Although, in the present application, one or more embodiments of the present invention is applied to a pachinko machine as an example of the amusement machine, the application of the present invention is not limited thereto. That is, one or more embodiments of the present invention can be applied to other types of amusement machines such as slot machines and various types of game machines, or can be applied to various types of devices other than amusement machines which accept an operation input from users, for example.

As illustrated in FIG. 1, the pachinko machine 1 is equipped with a game area 11, a display 12, a handle 13, an upper tray 14, a lower tray 15, a staging operation unit 16, and the like.

The game area 11 is an area in which a game ball (game medium) launched by the handle 13 moves.

The handle 13 is a device for performing a launch operation of the game ball, and when the user turns the handle 13 and keeps the handle 13 as it is, the game balls are continuously launched into the game area 11.

In the upper tray 14, the game balls obtained through the game are stored, and in the lower tray 15, the game balls having overflown from the upper tray 14 are stored. In addition, the lower tray 15 is provided with a discharge outlet for discharging the game balls and a discharge shutter for opening/closing the discharge outlet (neither of them shown), and when the user performs an operation for opening the discharge shutter, the game balls stored in the lower tray 15 are discharged from the lower tray 15 downward of the lower tray 15.

On the display 12, there are displayed various staged images depending on the states of the game and various images and information such as operation guide information to be shown to the user.

The staging operation unit 16 is an instruction input unit for the user of the pachinko machine 1 to input an instruction in the pachinko machine 1. The content of the instruction input is not specifically limited, and examples include: (i) an instruction of operation (for example, an instruction for moving a character, an instruction for selecting the character, a requirement of increment/decrement of various indicator images, and the like) on the staged image displayed on the display 12; and (ii) an instruction for selecting various pieces of information (for example, information of specifications of the pachinko machine 1, explanatory information of the staging, history information of a big hit, and the like) to be displayed on the display 12.

In one or more embodiments of the present invention, the staging operation unit 16 is equipped with a rotary operation function (dial operation function) in which the user inputs an instruction by a rotary operation and a push-in operation function (button operation function) in which the user inputs an instruction by a push-in operation. In addition, the staging operation unit 16 is equipped with an accessory having a movable mechanism and an electric accessory mechanism. The staging operation unit 16 will be described in detail later.

The operations of various parts of the pachinko machine 1 are controlled by a controller (not shown) provided in the pachinko machine 1. The controller is made up of, for example, a CPU (Central Processing Unit) and the like, and the controller controls the various parts of the pachinko machine 1, based on detection results of various sensors provided in the pachinko machine 1, instructions of operation, from the user, to the staging operation unit 16, and a program and various data stored in a storage unit (not shown) such as a ROM.

For example, the controller receives from the staging operation unit 16 a signal depending on the operation (the rotary operation and/or the push-in operation) performed by the player (the user) on the staging operation unit 16, and controls depending on the signal the display content on the display 12 and the operation of the accessory and an electric accessory member provided on the pachinko machine 1.

In addition, the controller controls, depending on a state of progress of the game, a result of lottery on the game, and the like, the accessory (including an accessory 50 provided on the staging operation unit 16), the electric accessory member, and the like provided on the pachinko machine 1.

(1-2. Configuration of Staging Operation Unit 16)

Figure 2:
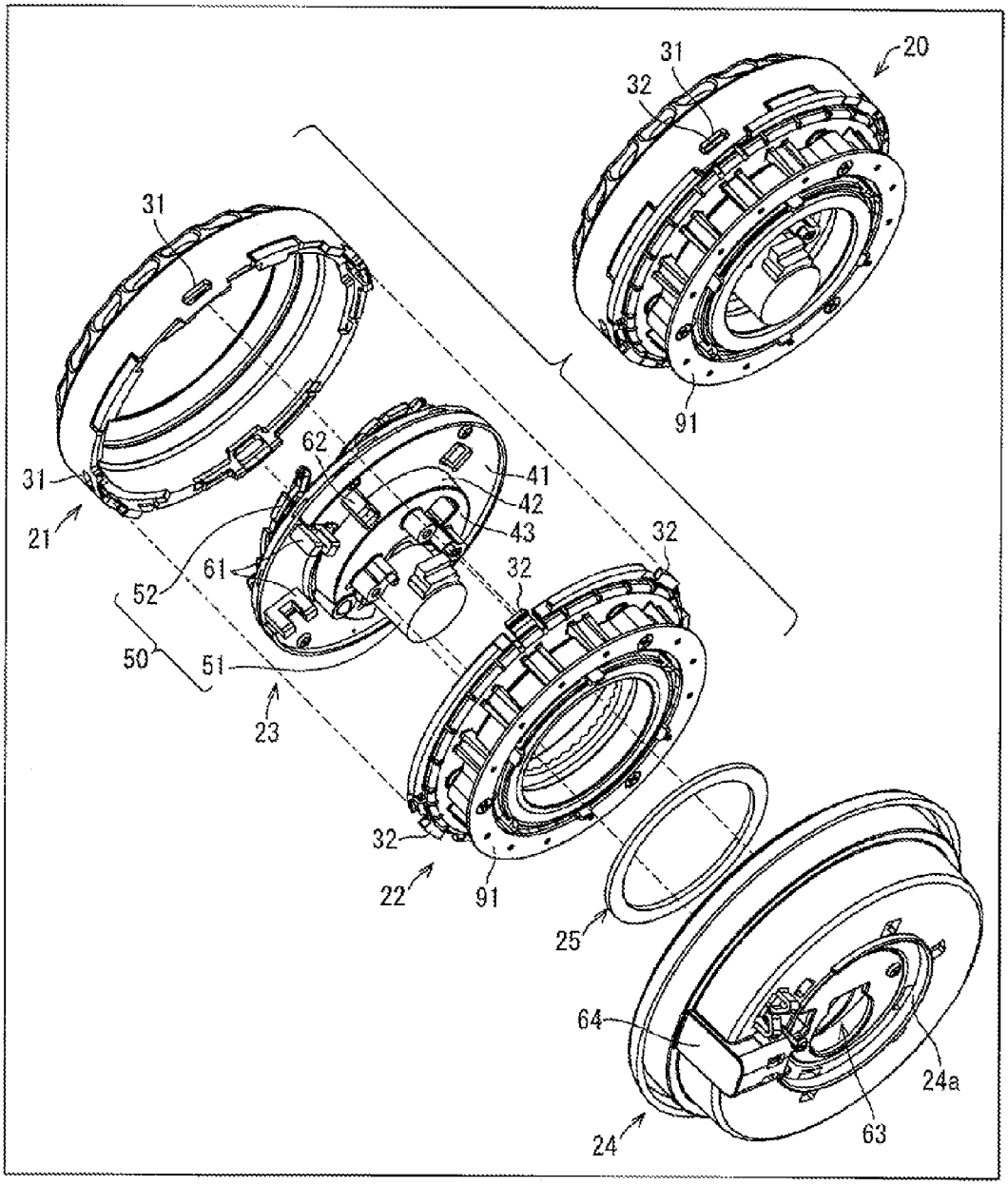
FIG. 2 is an exploded perspective view of an operation unit provided in the amusement machine illustrated in FIG. 1.
Figure 3:
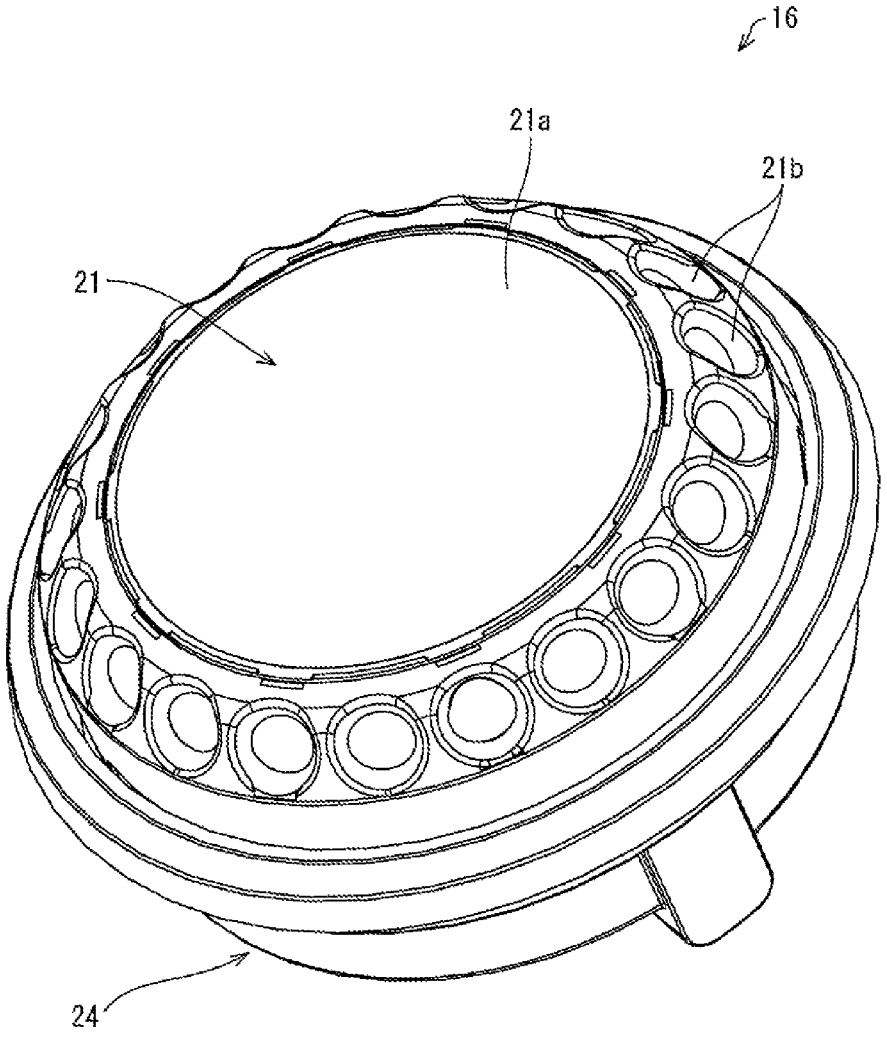
FIG. 3 is a perspective view of the operation unit illustrated in FIG. 2.
Figure 4:
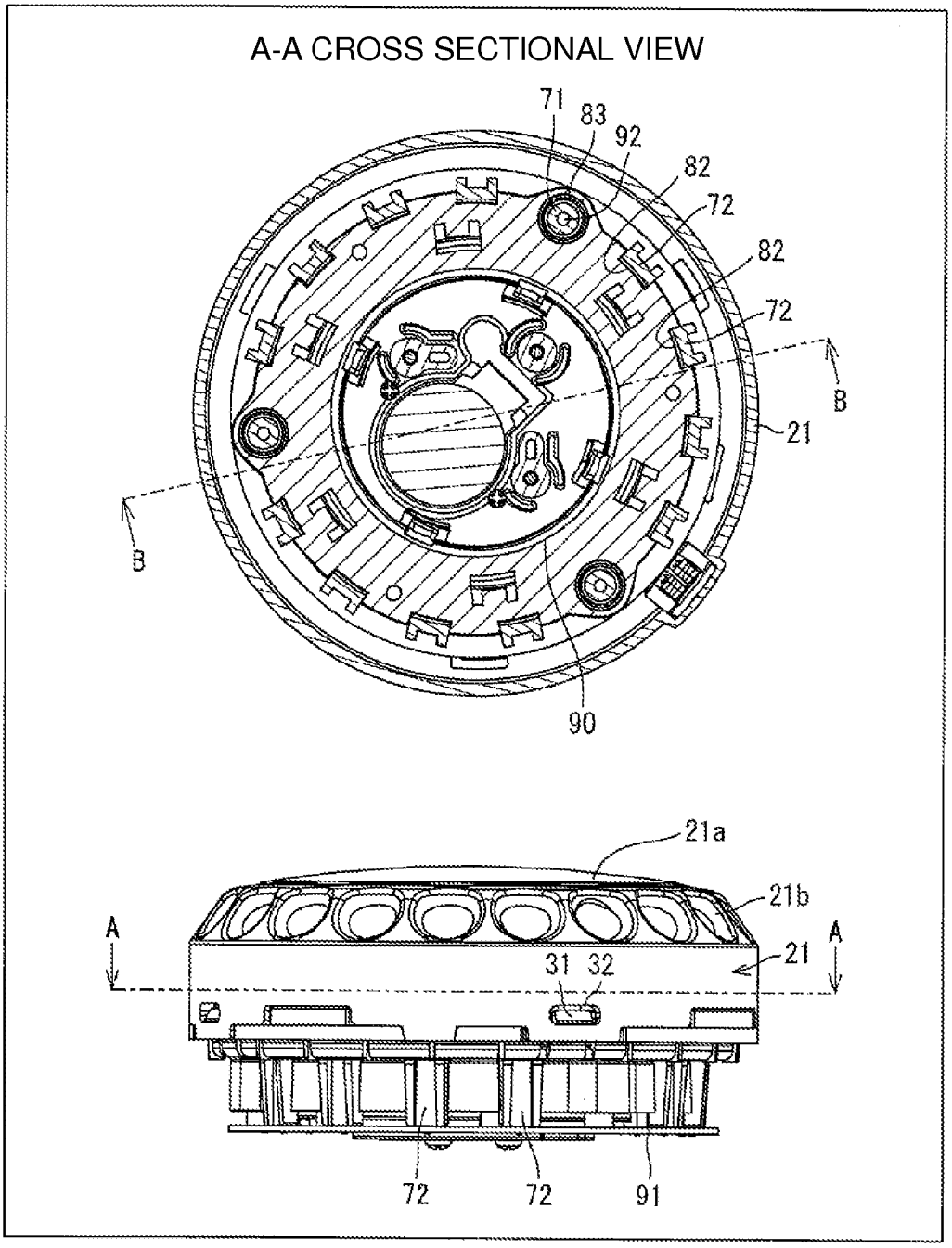
FIG. 4 is a side view and a cross sectional view of the operation unit illustrated in FIG. 2.
Figure 5:
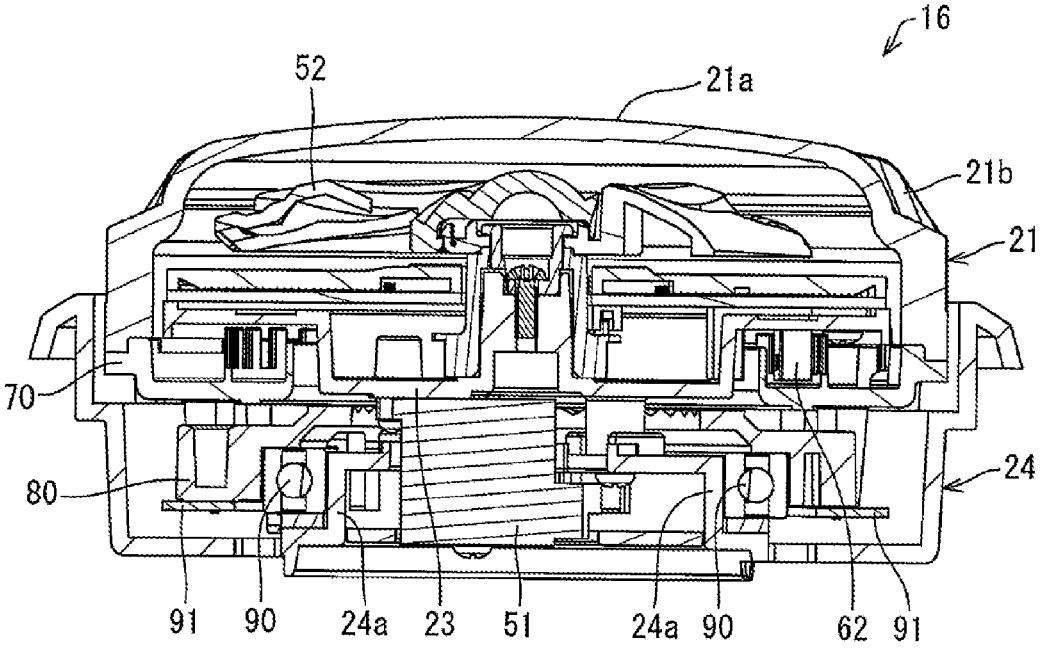
FIG. 5 is a cross sectional view of the operation unit illustrated in FIG. 2.

FIG. 2 is an exploded perspective view of the staging operation unit 16. FIG. 3 is a perspective view of the staging operation unit 16. FIG. 4 is a side view of the staging operation unit 16 and a cross sectional view of section A-A shown in the side view. FIG. 5 is a cross sectional view of section B-B illustrated in FIG. 4.

As illustrated in FIG. 2, the staging operation unit 16 is equipped with an operation cover unit 21, an operation movable member 22, a fixed mount unit 23, and a base member 24.

The operation cover unit 21 has a shape of an approximate cylinder one end of which is blocked, and the operation cover unit 21 is mounted on the operation movable member 22 so as to house the fixed mount unit 23 therein. In particular, on the operation movable member 22, there are provided along the circumferential direction a plurality of engagement hook members 32 which project on the operation cover unit 21 side, and the tips of which are bent outwardly in the circumferential direction, and on the positions which are on the circumferential surface of the operation cover unit 21 and correspond to the engagement hook members 32, there are provided engagement holes 31 with which the engagement hook member 32 are to be engaged.

Then, by engaging the engagement hook members 32 corresponding to the engagement holes 31 with the engagement holes 31, the operation cover unit 21 is mounted on the operation movable member 22. In this manner, the rotary member 20 is made to be an assembly of the operation cover unit 21 and the operation movable member 22.

When the user of the pachinko machine 1 performs an operation input on the operation cover unit 21 through the staging operation unit 16, the rotary operation (the dial operation) or the push-in operation (the button operation) is performed. That is to say, the operation cover unit 21 is used as an operation object for both the rotary operation and the push-in operation. In one or more embodiments of the present invention, as illustrated in FIG. 3, a top surface 21*a* of the operation cover unit 21 is an approximately flat plane, and the user performs the push-in operation on the top surface 21*a* when performing the push-in operation. In addition, the circumferential part of the top surface 21*a* is an inclined surface (a shape in which the corner of the top surface 21*a* is chamfered) which is inclined in the direction of the rotation axis of the staging operation unit 16, and on the inclined surface there are provided a plurality of recessed portions 21*b* along the circumferential direction of the top surface 21*a*. With this arrangement, when performing the rotary operation, the user performs the rotary operation, touching the recessed portions 21*b*. However, the shape of the operation cover unit 21 is not limited to this shape, the shape may be, for example, a hemispheric shape, or the top surface may have a concavo-convex shape or a curved surface shape. In addition, there is no limitation to the material of the operation cover unit 21, however in one or more embodiments of the present invention, the operation cover unit 21 is made of a material having transparency so that the user of the pachinko machine 1 can see a movable member 52 provided in the staging operation unit 16.

The fixed mount unit 23 is equipped with a fixed plate member 41, a fixed cylinder member 42, a fixed bottom plate member 43, the accessory 50, a rotation detection sensor (rotary operation detection unit) 61, and a push-in detection sensor (push-in operation detection unit) 62. The accessory 50 is equipped with an accessory drive motor (drive unit) 51, and the accessory (the movable member) 52 to be rotatably driven by the accessory drive motor 51. The movable member 52 is equipped with a light source unit made up of a plurality of LEDs (Light Emitting Diodes) and a light diffusion member configured to diffuse and stage the light emitted from the light source unit (neither shown).

Here, a description will be given of a configuration in which the accessory 50 is configured with: the movable mechanism equipped with the accessory drive motor 51 and the movable member 52 driven by the accessory drive motor 51; and the electric accessory mechanism equipped with the light source unit and a light guide member. However, the configuration of the accessory 50 is not limited thereto. For example, only the movable mechanism may be included, or only the electric accessory mechanism may be included. Further, the movable member 52 may be configured to be moved or deformed, other than configured to be rotatably driven.

The fixed plate member 41 is a flat ring-shaped member, the fixed cylinder member 42 is a cylindrical-shaped member having a diameter depending on the inner diameter of the fixed plate member 41, and the fixed bottom plate member 43 is a circular-shaped member provided so as to block one end (an open end on the base member 24 side) of the fixed cylinder member 42. Alternatively, it may be possible that the fixed plate member 41, the fixed cylinder member 42, and the fixed bottom plate member 43 are integrally formed.

On the fixed bottom plate member 43, the accessory drive motor 51 is attached. A rotation shaft (not shown) of the accessory drive motor 51 penetrates through a hole (not shown) formed in the fixed bottom plate member 43, and the rotation shaft is coupled, via a transmission unit such as a gear, to the movable member 52 disposed on the surface (the area which is between the fixed plate member 41, the fixed cylinder member 42, and the fixed bottom plate member 43 and the operation cover unit 21, and which overlaps at least a part of the fixed plate member 41, the fixed cylinder member 42, and the fixed bottom plate member 43 when viewed from the direction along the rotation shaft during the rotary operation), of the fixed bottom plate member 43, on the operation cover unit 21 side. With this arrangement, the rotation drive force of the accessory drive motor 51 is transmitted to the movable member 52 via the rotation shaft and the transmission unit, and the movable member 52 is driven relatively rotatably with respect to the fixed plate member 41, the fixed cylinder member 42, the fixed bottom plate member 43, and the accessory drive motor 51.

The rotation detection sensor 61 and the push-in detection sensor 62 are fixed on the surface on the operation movable member 22 side of the fixed plate member 41. The rotation detection sensor 61 detects the rotation of the operation movable member 22 with respect to the fixed plate member 41, and the push-in detection sensor 62 detects the movement of a part of the operation movable member 22 (pushed-in movable member 70 to be described later) in the push-in direction (parallel to the center of the rotation axis of the rotary member 20 and on the base member 24 side) with respect to the fixed plate member 41. The detection results of the rotation detection sensor 61 and the push-in detection sensor 62 are transmitted to the controller (not shown) of the pachinko machine 1. This arrangement allows the controller to recognize the contents of the rotary operation and the push-in operation of the user on the staging operation unit 16 and to control the operations (for example, display of the display 12) of various parts of the pachinko machine 1 according to the contents. The rotary operation detection unit 61 and the push-in operation detection unit 62 are disposed entirely within the rotary member 20. The rotary operation detection unit 61 and the push-in operation detection unit 62 are disposed in a common plane perpendicular to the direction along the rotation axis of the bearing member 90.

The base member 24 is a member fixed on the pachinko machine 1 (on the upper tray 14 of the pachinko machine 1, in one or more embodiments of the present invention). At the position, on the base member 24, corresponding to the accessory drive motor 51, there is provided an opening 63 corresponding to the shape of the accessory drive motor 51, and the fixed mount unit 23 is fixed on the base member 24, sandwiching the operation movable member 22 and a seat bearing 25 between the fixed mount unit 23 and the base member 24 by inserting the accessory drive motor 51 in the opening 63.

In this arrangement, the fixed plate member 41, the fixed cylinder member 42, the fixed bottom plate member 43, the rotation detection sensor 61, and the push-in detection sensor 62 are fixed so that the fixed plate member 41 is not moved or rotated relatively with respect to the base member 24. Further, the operation movable member 22 is rotatably mounted between the base member 24 and the fixed mount unit 23 to be rotatable with respect to the base member 24 and the fixed mount unit 23.

In particular, as illustrated in FIG. 5, on the base member 24 is provided a fixing member (convex portion) 24*a* having a cylindrical shape projecting on the operation cover unit 21 side, and the inner diameter side surface of a bearing member (bearing) 90 is fit in the circumferential surface of the fixing member 24*a*. The outer diameter side surface of the bearing member 90 is mounted on the operation movable member 22. With this arrangement, the operation movable member 22 is rotatably mounted on the circumferential surface of the fixing member 24*a* of the cylindrical shape of the base member 24, via the bearing member 90. A ball of the bearing member 90 is disposed on an outer diameter of the convex portion 24*a*.

The movable member 52 is able to rotate by a rotation drive force from the accessory drive motor 51 with respect to the base member 24 and the fixed mount unit 23, and the rotating movement of the movable member 52 is controlled independently of the rotating movement of the rotary member 20 (the operation movable member 22 and the operation cover unit 21).

On the base member 24 is mounted a vibration motor 64, which is made to vibrate by the controller (not shown) of the pachinko machine 1, and the vibration of the vibration motor 64 vibrates the operation movable member 22 and the operation cover unit 21.

Figure 6:
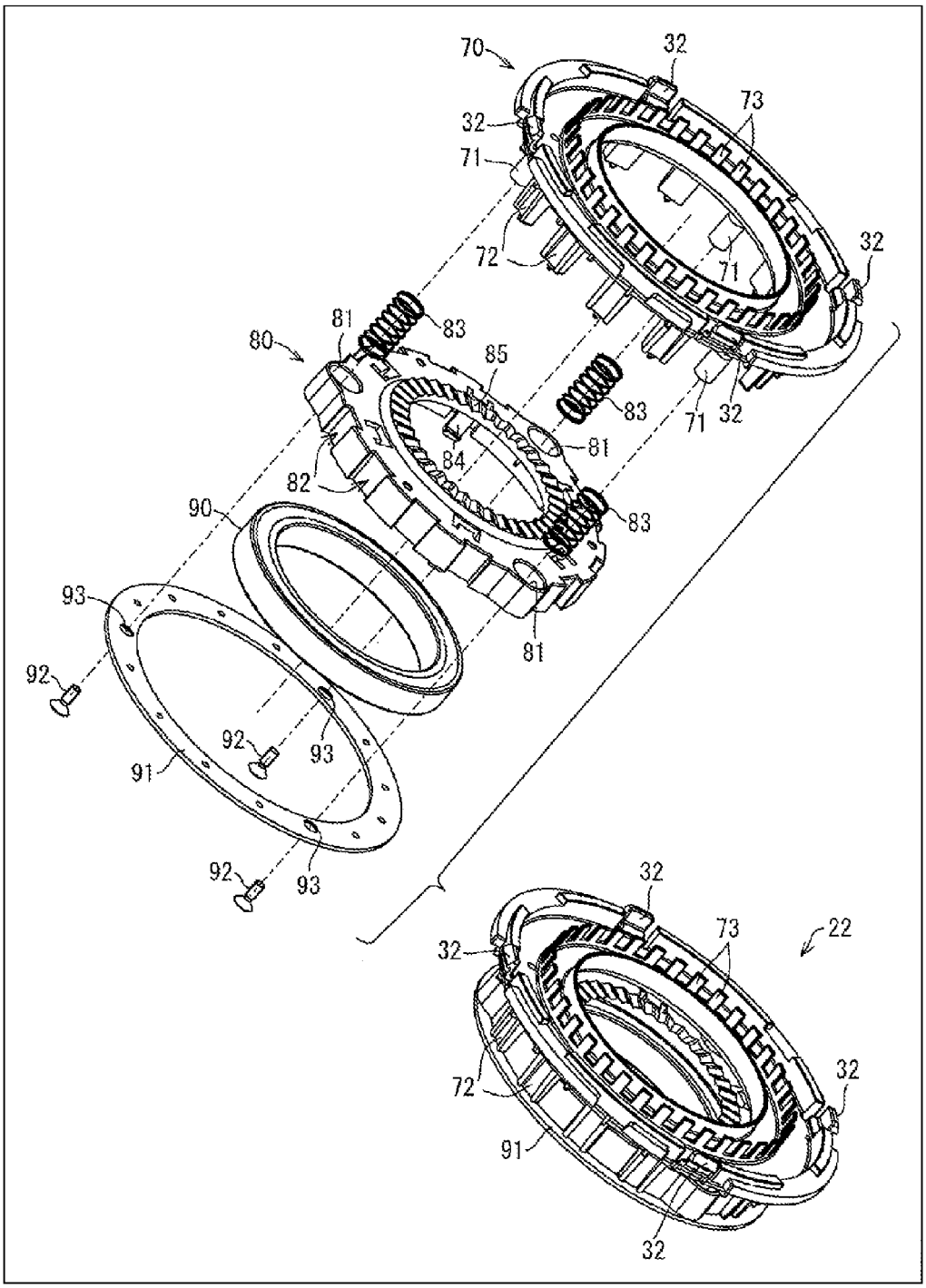
FIG. 6 is an exploded perspective view of an operation movable member provided in the operation unit illustrated in FIG. 2.

FIG. 6 is an exploded perspective view of the operation movable member 22. As illustrated in this drawing, the operation movable member 22 is equipped with a pushed-in movable member 70, a rotatable base member 80, a bearing member 90, and a weight ring (weight) 91.

On the operation cover unit 21 side surface of the pushed-in movable member 70 are provided the plurality of engagement hook members 32 and a plurality of encoders 73 which are equidistantly arranged along the circumferential direction to be projected on the operation cover unit 21 side.

The engagement hook members 32 are engaged with the engagement holes 31 provided in the operation cover unit 21, and by this engagement, the operation cover unit 21 are fixedly mounted on the pushed-in movable member 70.

The encoders 73 are disposed at the positions corresponding to the rotation detection sensor 61 mounted on the fixed mount unit 23. The rotation detection sensor 61 counts the number of encoders 73 passing through a detection position of the rotation detection sensor 61 due to the rotation of the operation movable member 22, whereby the rotation detection sensor 61 detects a rotation angle (an amount of rotary displacement) of the operation movable member 22.

On the rotatable base member 80 side of the pushed-in movable member 70 are provided spring insertion members 71 projecting in the push-in direction and sliding guides (projecting portion) 72. In one or more embodiments of the present invention, three spring insertion members 71 are equidistantly arranged along the circumferential direction, and between each of the three spring insertion members 71 are arranged four (total twelve) sliding guides 72 along the circumferential direction. The spring insertion members 71 have a cylindrical shape, and in each cylindrical shape is formed a screw hole (not shown) in which a bolt 92 to be described later is mounted.

At the position corresponding to each of the spring insertion members 71 of the rotatable base member 80, there is provided a spring housing 81 constituted by an opening penetrating through along the push-in direction, and at the position corresponding to each of the sliding guides 72, there is provided a guide holder (holder) 82 configured to house each of the sliding guides 72.

On the side, of the rotatable base member 80, opposite to the push-in direction are formed many concavo-convex grooves 85 along the circumferential direction. At the position, on the fixed mount unit 23, corresponding the concavo-convex grooves 85, there is provided a spherical member (not shown) in contact with the concavo-convex grooves 85, and when the rotatable base member 80 is rotatably operated, the spherical member slides on the concavo-convex grooves 85, whereby rotational friction cyclically varies, thereby providing the user with a feeling of click (operational feeling of rotation).

In the rotatable base member 80, there is provided along the circumferential direction a plurality of bearing holding hooks 84 which protrude on the push-in direction side and the tips of which are bent inwardly in the radial direction. These bearing holding hooks 84 support the outer diameter side of the bearing member 90. The inner diameter side of the bearing member 90 is fixed on the fixing member 24*a* of the cylindrical shape of the base member 24 as described above. With this arrangement, the rotatable base member 80 is mounted relatively rotatably with respect to the base member 24 and the fixed mount unit 23.

The weight ring 91 is a weight member having a ring shape configured to increase a moment of inertia created in the rotary member 20 when the rotary member 20 (the assembly of the operation cover unit 21 and the operation movable member 22) is rotatably operated. Although here, a ring-shaped weight member is employed, the present invention is not limited thereto. For example, a plurality of weight members may be arranged in the circumferential direction of the rotary member 20. In addition, a material of the weight ring 91 is not specifically limited if the material can provide an appropriate weight to the rotary member 20, and a metal material such as iron or lead can be used, for example. At the positions, on the weight ring 91, corresponding to the spring housings 81, there are provided openings 93 depending on the outer diameters of the bolts 92 to be described later.

In the process of assembling the pushed-in movable member 70, the rotatable base member 80, and the weight ring 91, while keeping the bearing member 90 put on the bearing holding hooks 84 of the rotatable base member 80, the springs 83 is housed in the spring housings 81, and the spring insertion members 71 are inserted into the springs 83 housed in the spring housings 81, and the bolts 92 are attached on the spring insertion members 71 through the openings 93 of the weight ring 91. At this time, the respective sliding guides 72 are housed in the corresponding guide holders 82.

Each sliding guide 72 has a shape to extend in the push-in direction as illustrated in FIG. 4, and the cross section perpendicular to the extending direction has an approximate U shape. In addition, the both side surfaces in the rotational direction are flat, the internal side surface on the radial direction (the rotation axis side) is a curved surface having a curvature corresponding to a rotational locus of the sliding guides 72. However, the inner side surface in the radial direction may have a planar shape.

The guide holders 82 are formed so as to allow the sliding guides 72 to move in the push-in direction and so as to control the movement of the sliding guides 72 in the rotational direction and the inclination of the sliding guides 72 with respect to the push-in direction. In particular, the both side surfaces in the rotational direction (the two side wall surfaces) and the inner side surfaces (main wall surfaces) in the radial direction (on the rotation axis side) of the guide holders 82 have such a shape that the sliding guides 72 face the both side surfaces in the rotational direction and the inner surfaces in the radial direction of the sliding guides 72, with a small gap enough for the sliding guides 72 to move in the push-in direction. In addition, the outer side surfaces of the guide holders 82 are opened.

Figure 10:
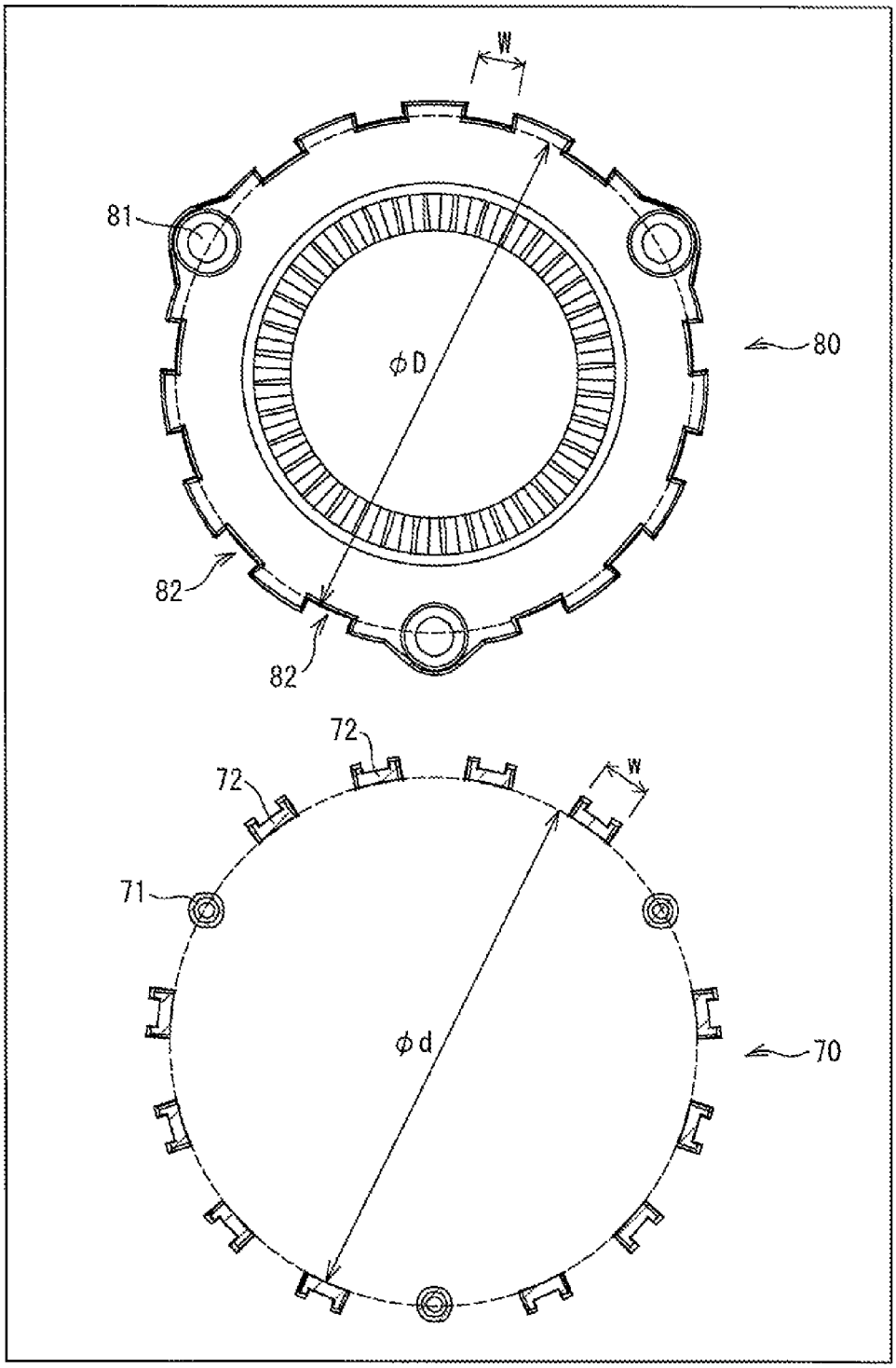
FIG. 10 is an explanatory diagram illustrating the relation between a pushed-in movable member and a rotatable base member provided in the operation unit illustrated in FIG. 2.

FIG. 10 is a plan view of the pushed-in movable member 70 and the rotatable base member 80. As illustrated in this drawing, the sliding guides 72 of the pushed-in movable member 70 are arranged such that the inner side surfaces, of the sliding guides 72, in the radial direction are located along the circle centered at the rotation axis (the center of the rotation axis) with a diameter of φd. In addition, the guide holders 82 of the rotatable base member 80 are arranged such that the inner side surfaces in the radial direction are located along the circle, centered at the rotation axis, with a diameter of φD. The diameter φD is set slightly greater than the diameter φd. In addition, as illustrated in FIG. 10, the width w, in the circumferential direction, of the sliding guides 72 of the pushed-in movable member 70 is set slightly smaller than the width W, in the circumferential direction, of the guide holders 82 of the rotatable base members 80.

Figure 7:
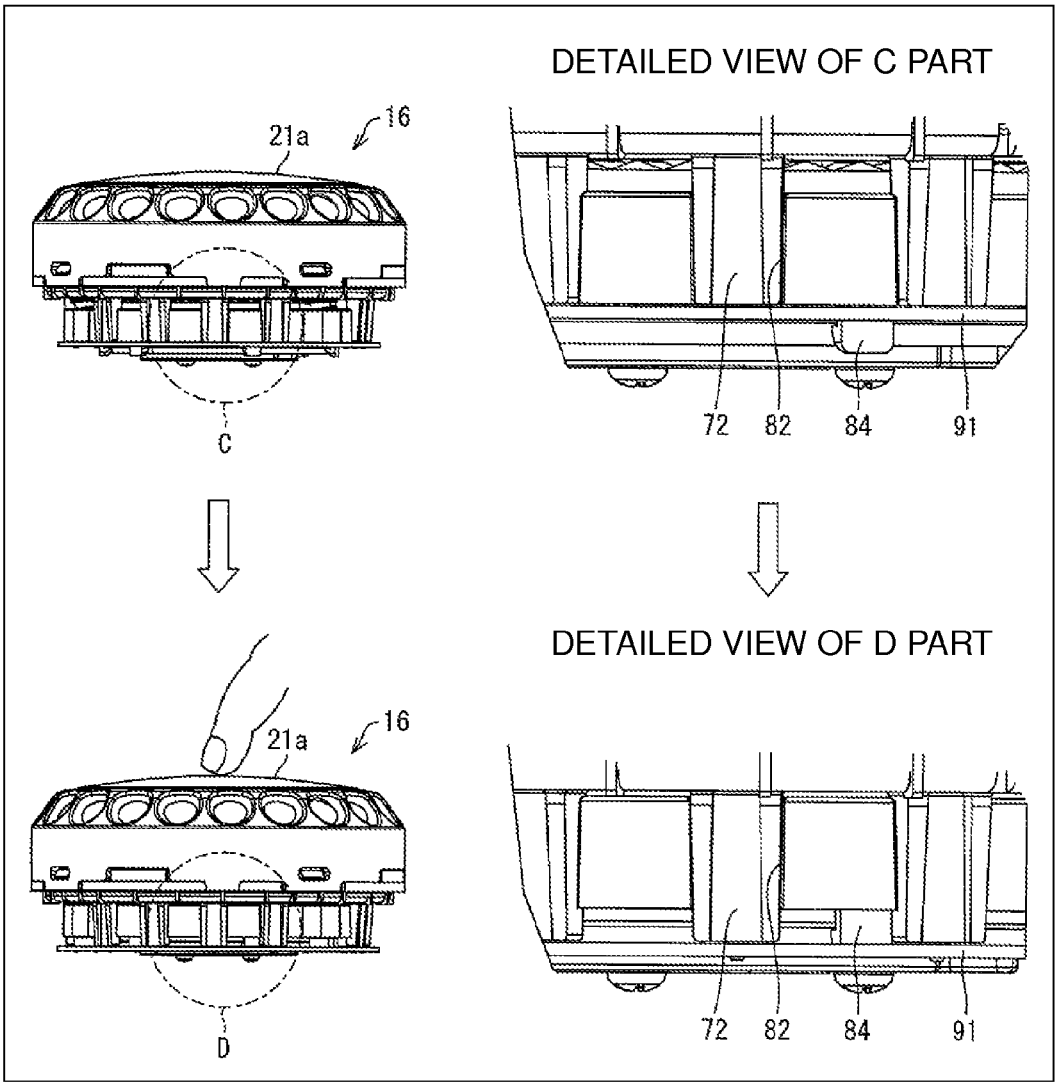
FIG. 7 is an explanatory diagram illustrating states before and after a push-in operation in the operation unit illustrated in FIG. 2.
Figure 8A:
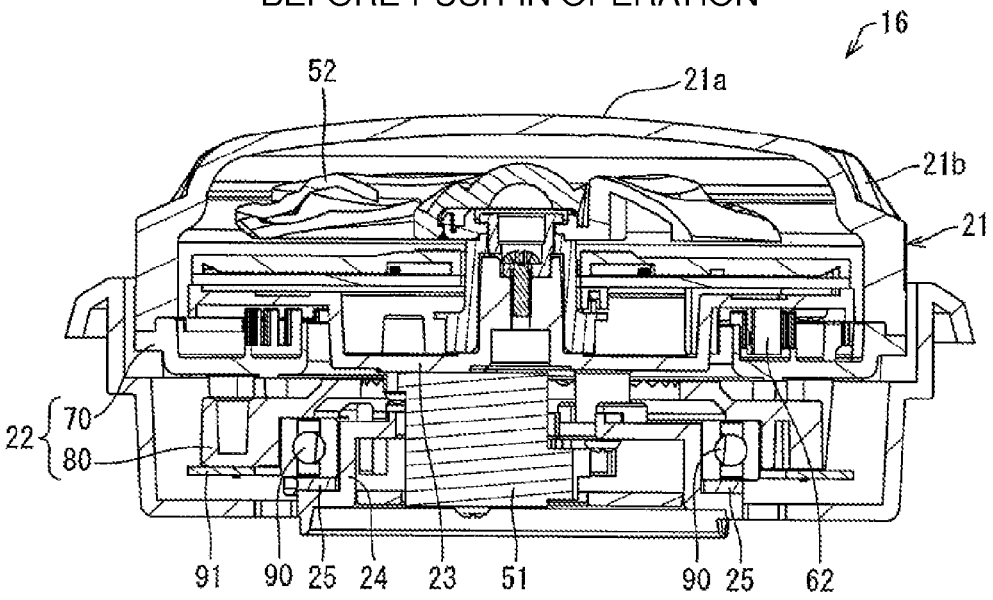
FIGS. 8*a* and 8*b* are cross sectional views illustrating states before and after the push-in operation in the operation unit illustrated in FIG. 2.
Figure 8B:
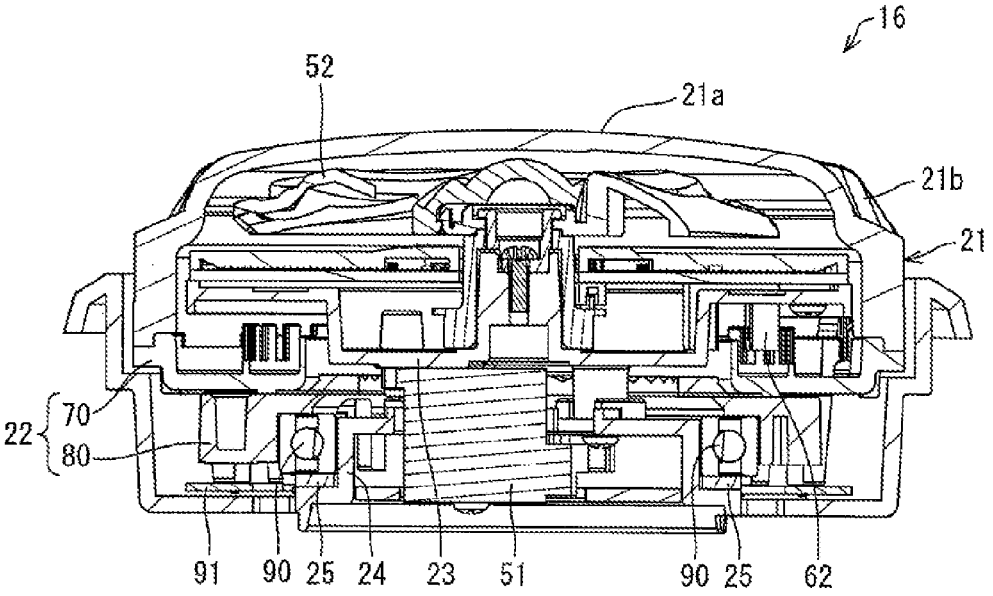

FIG. 7 and FIGS. 8*a*, 8*b* are an explanatory diagram and cross sectional views, respectively, illustrating the states before and after the push-in operation.

As illustrated in FIG. 7, when the user performs an operation (push-in operation) of pushing in the top surface 21*a* of the operation cover unit 21, the operation cover unit 21 and the pushed-in movable member 70 are pushed in by overcoming an elastic force of the springs 83, whereby the sliding guides 72 move in the push-in direction along the guide holders 82. In addition, as illustrated in FIGS. 8*a* and 8*b*, the operation cover unit 21 and the pushed-in movable member 70 moves in the push-in direction with respect to the rotatable base member 80, the fixed mount unit 23, and the base member 24. On the fixed mount unit 23, the push-in detection sensor 62 is mounded as described above, and the push-in detection sensor 62 detects that the pushed-in movable member 70 has moved in the push-in direction, whereby a signal indicating that the push-in operation was performed is transmitted to the controller of the pachinko machine 1.

Figure 9A:
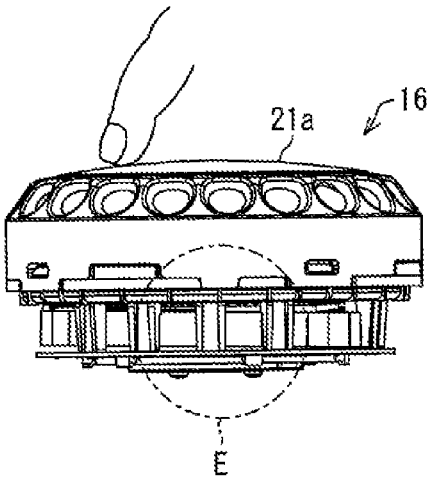
FIGS. 9*a*, 9*b*, and 9*c* are explanatory diagrams illustrating states at the time of performing the push-in operation in the operation unit illustrated in FIG. 2.
Figure 9B:
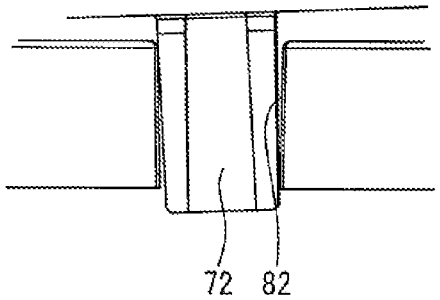

In addition, as described above, the distances between the both side surfaces in the rotational direction and the inner side surface in the radial direction of the sliding guide 72 and the surfaces (the two side wall surfaces and the main wall surface) of the guide holder 82 facing the surfaces of the sliding guide 72 are made to be small enough for the sliding guide 72 to move in the push-in direction. With this arrangement, as illustrated in FIGS. 9*a* and 9*b*, for example, when the user performs the push-in operation in a vicinity (a position, on the operation cover unit 21, decentered from the center of the rotation (the center of the rotation axis) at the time of the rotary operation) of the circumference of the top surface 21*a*, any of the rotational direction side surfaces and the inner side surface in the radial direction of each of the sliding guides 72 comes in contact with any of the rotational direction side surfaces (side wall surfaces) and the inner side surfaces in the radial direction (main wall surface) of the guide holders 82. In particular, as for the sliding guide 72 on the line passing through the rotation center of the rotatable base member 80 and the position on (or in the vicinity of) which the push-in operation was performed, the inner side surface in the radial direction comes in contact with the guide holder 82. Further, as for the sliding guide 72 located in (or near) the direction perpendicular to the above-described line with respect to the rotation center of the rotatable base member 80, the rotational direction side surface comes in contact with the guide holder 82. This arrangement controls the inclination of the operation cover unit 21 and the pushed-in movable member 70 with respect to the push-in direction (the direction parallel to the center of the rotation axis of the rotary member 20). As a result, it is prevented that foreign matter such as dust gets in a gap created between the components due to the inclination of the operation cover unit 21 and the pushed-in movable member 70 and that a component is damaged by performing the push-in operation under the state that the operation cover unit 21 and the pushed-in movable member 70 are inclined.

Figure 9C:
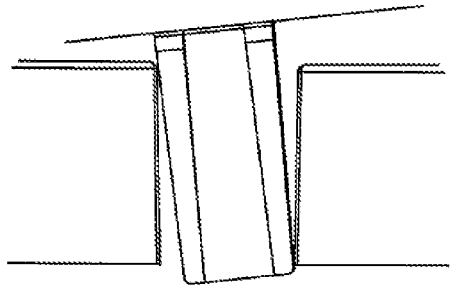

However, when the gaps between the sliding guides 72 and the guide holders 82 are too wide, the inclination of the operation cover unit 21 and the pushed-in movable member 70 cannot be sufficiently controlled as the comparative example illustrated in FIG. 9*c*.

Figure 11:
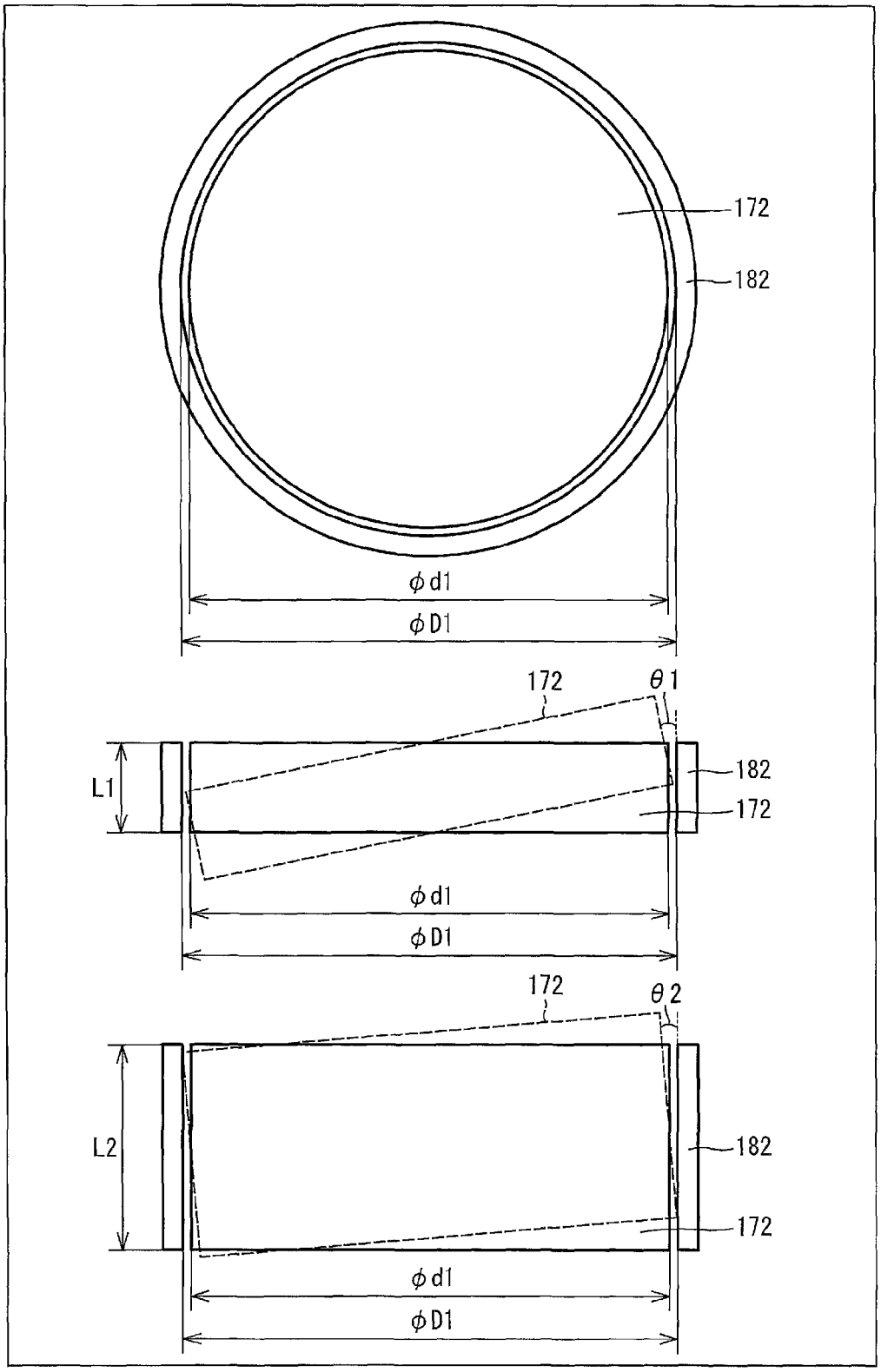
FIG. 11 is an explanatory diagram illustrating the relation between a pushed-in movable member and a rotatable base member provided in the operation unit illustrated in FIG. 2.

Further, as illustrated in FIG. 11, for example, in the case that a ring-shaped (cylindrical shape) sliding guide 172 with a diameter of φd1 and a ring-shaped (cylindrical shape) guide holder 182 with a diameter φD1 for housing the sliding guide 172 are provided, the maximum inclination angle of the pushed-in movable member 70 is smaller when the length of the sliding guide 172 in the push-in operation direction is longer. In particular, as illustrated in FIG. 11, assuming the case that the length of the sliding guide 172 in the push-in operation direction is L1 and the case that the length is L2 (where L1<L2), the relation between the maximum inclination angle φ1 for the case of the length L1 and the maximum inclination angle φ2 for the case of the length L2 is φ1>φ2. In this case, the sliding guide 172 and the guide holder 182 are in contact with each other in an area (or the concerned area and the vicinity area thereof) on a line passing through the rotation center of the sliding guide and the position of the push-in operation. Thus, in the configuration in which the ring-shaped sliding guide 172 and the ring-shaped guide holder 182 are provided, in order to control the inclination of the rotatable base member 80 and the pushed-in movable member 70, the length of the sliding guide 172 in the push-in direction needs to be very long.

In contrast, in the configuration of one or more embodiments of the present invention, by the plurality of sliding guides 72 arranged along the circumferential direction of the rotatable base member 80 being in contact with the guide holders 82, the inclination of the operation cover unit 21 and the pushed-in movable member 70 can be controlled. For this reason, the length of the sliding guide 72 in the push-in direction needed to control the inclination of the operation cover unit 21 and the pushed-in movable member 70 can be shorter than in the case that the cylindrical shape sliding guide is provided surrounding the rotatable base member 80 in the circumferential direction. For example, the length of the sliding guides 72 in the push-in direction needed to control the inclination of the operation cover unit 21 and the pushed-in movable member 70 can be shorter than an inner diameter of the bearing member 90. As a result, the length of the staging operation unit 16 in the push-in direction can be shortened, whereby the staging operation unit 16 can be downsized.

Here, the sliding guides 72 are provided on the pushed-in movable member 70, and the guide holders 82 are provided in the rotatable base member 80; however, the configuration is not limited thereto. For example, the sliding guides 72 may be provided on the rotatable base member 80, and the guide holders 82 may be provided in the pushed-in movable member 70.

As described above, the staging operation unit 16 according to one or more embodiments of the present invention is equipped with: the base member 24 having the fixing member 24*a* in a cylindrical shape; the rotary member 20; the bearing member 90 provided on the circumference side of the fixing member 24*a* and configured to mount thereon the rotary member 20 to be rotatable with respect to the fixing member 24*a*; and the accessory 50 constituted by the accessory drive motor (drive unit) 51 and the movable member 52 to be driven by the accessory drive motor 51. In the above configuration, the rotary member 20 includes: the rotatable base member 80 mounted by the bearing member 90 rotatably with respect to the fixing member 24*a*; and the pushed-in movable member 70 provided movably in a predetermined direction with respect to the rotatable base member 80. In addition, the staging operation unit 16 includes: the rotary operation function for outputting the signal depending on the rotary operation in which the rotary member 20 is driven along the circumferential direction of the fixing member 25*a*; and the button operation function for outputting the signal depending on the push-in operation in which the pushed-in movable member 70 is pushed in the predetermined direction, and at least the part of the accessory 50 is disposed inside the fixing member 25*a*.

This configuration realizes a multifunctional staging operation unit of high staging capability which has the rotary operation function, the push-in operation function, and the accessory function. In addition, compared to the case that the rotary operation function, the push-in operation function, and the accessory function are each realized by different configurations, an installation space is reduced and the number of components is reduced, whereby cost-cutting can be achieved.

Further, in the staging operation unit 16, at the outer position, in the radial direction of the fixing member 24*a*, than the bearing member 90, the weight ring (weight member) 91 is mounted to increase the moment of inertia which acts on the rotary member 20 when the rotary operation of the rotary member 20 is performed.

With this arrangement, by arranging the accessory 50 inside the fixing member 24*a*, even if the outer diameters of the fixing member 24*a* and the rotary member 20 are made large, the moment of inertia acting on the rotary member 20 is increased by the weight ring 91 when the rotary operation of the rotary member 20 is performed, whereby the rotary operation of the rotary member 20 can be performed easily and smoothly.

The present invention is not limited to the above-described embodiments, and various modifications can be done within the scope described in the claims. In other words, embodiments obtained by combining technical measures modified as appropriate within the scope described in the claims are included in the technical scope of the present invention.

One or more embodiments of the present invention can be applied to staging operation units which are installed in various devices for a user to perform an operation input.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A staging operation unit comprising:

a base member comprising a convex portion;

a rotary member;

a fixed mount unit disposed in the rotary member; and a bearing member fixed on the convex portion, that has the rotary member mounted thereon rotatably with respect to the base member, wherein the rotary member comprises:

a pushed-in movable member that accepts a push-in operation in a direction along a rotation axis of the bearing member, wherein the fixed mount unit comprises:

a rotary operation detection unit that is disposed entirely within the rotary member, and that detects rotation of the rotary member and outputs a signal corresponding to a result of the detection of the rotation, and a push-in operation detection unit that is disposed entirely within the rotary member, and that detects the push-in operation of the pushed-in movable member and outputs a signal corresponding to a result of the detection of the push-in operation, and wherein the rotary operation detection unit and the push-in operation detection unit are disposed in a common plane perpendicular to the direction along the rotation axis of the bearing member.

2. The staging operation unit of claim 1, comprising:

a weight member provided at an outer position, in the radial direction of the bearing member, from the bearing member, wherein the weight member increases a moment of inertia which acts on the rotary member when a rotary operation of the rotary member is performed.

3. The staging operation unit of claim 2, wherein the weight member has a ring shape whose inner diameter is larger than an outer diameter of the bearing member.

4. The staging operation unit of claim 1, further comprising:

an accessory mounted on the fixed mount unit, wherein the accessory comprises an accessory drive motor and a movable member, wherein the movable member is disposed within the rotary member, and wherein at least a part of the accessory drive motor is disposed within the convex portion.

5. The staging operation unit of claim 1, wherein a ball of the bearing member is disposed on an outer diameter of the convex portion.

* * * * *